US005080666A

United States Patent [19]

Kulpa et al.

[11] Patent Number: 5,080,666

[45] Date of Patent: Jan. 14, 1992

[54] DOCUMENT ALIGNING APPARATUS

[75] Inventors: Walter J. Kulpa, Trumbull; William D. Toth, Milford, both of Conn.; Philip V. Bayly, Chapel Hill, N.C.; Joseph W. Guiles, Prospect, Conn.; Mary Jo Brigante, North Haven, Conn.; James Morabito, Bethel, Conn.

[73] Assignee: Pitney Bowes Inc., Stamford, Conn.

[21] Appl. No.: 599,193

[22] Filed: Oct. 17, 1990

[51] Int. Cl.[5] ..... B65H 7/02

[52] U.S. Cl. ..... 271/227; 271/243; 271/270; 271/2

[58] Field of Search ..... 271/2, 227, 234, 225, 271/235, 242, 243, 244, 198, 270, 202, 275; 198/434, 461, 626.5

[56] References Cited

U.S. PATENT DOCUMENTS

| | | | |
|---|---|---|---|
| 4,314,644 | 2/1982 | Stocker | 271/184 |
| 4,508,210 | 4/1985 | Ramcke et al. | 198/626.5 |
| 4,631,681 | 12/1986 | Salazar et al. | 101/91 |
| 4,838,408 | 6/1989 | Brown | 198/461 |
| 4,968,017 | 11/1990 | Depetris | 271/202 |

FOREIGN PATENT DOCUMENTS

| | | | |
|---|---|---|---|
| 0070639 | 3/1990 | Japan | 271/243 |
| 1151493 | 5/1969 | United Kingdom | 271/243 |

*Primary Examiner*—H. Grant Skaggs

*Attorney, Agent, or Firm*—Donald P. Walker; David E. Pitchenik; Melvin J. Scolnick

[57] ABSTRACT

Apparatus for aligning a document, the apparatus comprising: structure for feeding a document in a downstream path of travel, the document have a downstream edge relative to the path of travel; structure for registering the downstream edge of a document in a direction extending transverse to the path of travel, the registering structure including at least one member extending into the path of travel, the registering structure including structure for moving the at least one member downstream in the path of travel; and structure for controlling the feeding structure to urge a document into engagement with the at least one moving member.

16 Claims, 2 Drawing Sheets

DOCUMENT ALIGNING APPARATUS

BACKGROUND OF THE INVENTION

This invention is generally concerned with document aligning apparatus, and more particularly with apparatus for aligning documents of varying thickness.

This application is related to U.S. Pat. Application Ser. No. 07/599,192 for Document Feeding Apparatus filed concurrently herewith.

As shown in U.S. Pat. No. 4,314,644 for a Zip Code Registration System, issued Feb. 9, 1982 to Stocker, a series of movable balls, located at successive downstream intervals in the path of travel of successive documents being fed to a transversely moving conveyor, have been selectively raised or lowered relative to the conveyor in response to sensing different zip codes marked on the documents, for selectively engaging the leading edges of the successive documents at different positions in the path of travel, to register such leading edges along different lines extending in the direction of movement of the transversely moving conveyor.

As shown in U.S. Pat. No. 4,631,681, for a Microprocessor Controlled D.C. Motor And Application Therefor, issued Dec. 23, 1986 to Salazar et al, a microprocessor controlled d.c. motor, programmed for comparing the actual linear displacement of the periphery of a printing drum with a desired displacement of a sheet being fed thereto during successive sampling time periods, has been utilized in a closed-loop, feedback control system for causing the drum's peripheral displacement to match the sheet's displacement during each sampling time period.

Thus it is generally known in the art to provide document aligning apparatus including movable structure for registering the edges of successive documents, fed in a path of travel, along lines located at different intervals in the path of travel. And it is known in the art to utilize a closed-loop feedback control systems for causing the peripheral speed of a printing drum to match the speed of a sheet fed thereto. Accordingly:

An object of the invention is to provide improved document aligning apparatus including movable document edge registration structure;

Another object is to provide improved apparatus for aligning an edge of a document moving in a path of travel along a predetermined line extending transverse to the path of travel; and Another object is to provide a closed-loop feedback control system for controlling movement of document edge registration structure.

SUMMARY OF THE INVENTION

Apparatus for aligning a document, the apparatus comprising: means for feeding a document in a downstream path of travel, the document have a downstream edge relative to the path of travel; means for registering the downstream edge of a document in a direction extending transverse to the path of travel, the registering means including at least one member extending into the path of travel, the registering means including means for moving the at least one member downstream in the path of travel; and means for controlling the feeding means to urge a document into engagement with the at least one moving member.

BRIEF DESCRIPTION OF THE DRAWINGS

As shown in drawings wherein like reference numerals designate like or corresponding parts throughout the several views.

DESCRIPTION OF THE PREFERRED EMBODIMENTS

Figure 1:
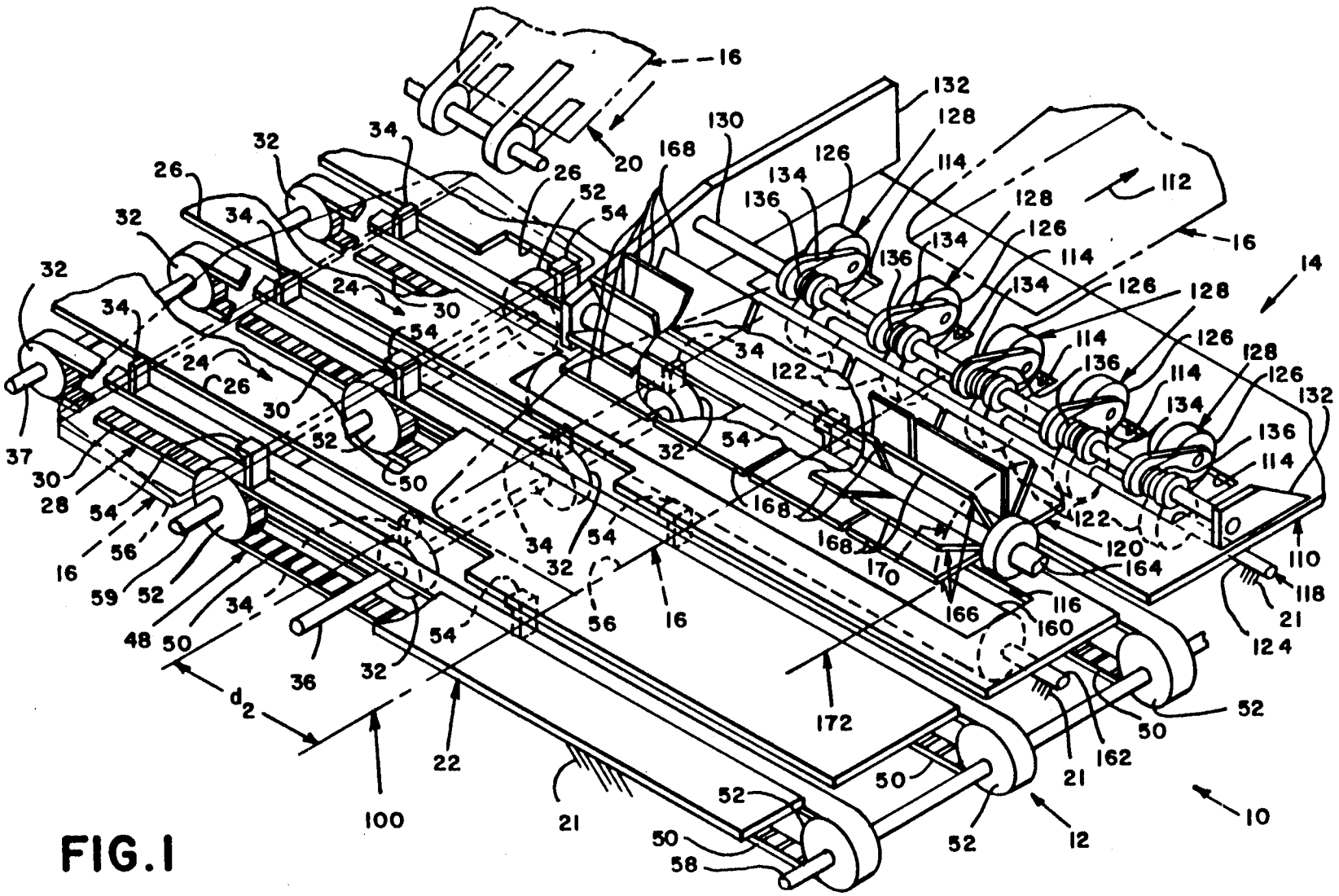
FIG. 1 is a perspective view of a system of apparatus according to the invention, including document aligning and feeding structures.

As shown in FIG. 1, a system 10 of apparatus according to the invention generally comprises document aligning structure 12, and document feeding structure 14 which is interfaced with the aligning structure 12 for feeding documents 16 therefrom.

For the purpose of this disclosure, a typical document 16 (FIG. 1), which may be aligned and fed by the system 10, may comprise an envelope, with or without one or more other documents stuffed therein which are or are not folded, or a sheet, such as a cut sheet, which is or is not folded, or a card, remittance form, mailpiece, or other sheet, or a collation of sheets which are or are not folded. And, although the document 16 is shown as being fed to the document aligning structure 12 from conventional belt-type document transporting structure 20, such structure 20 is intended to be representative of any document transporting apparatus which is constructed and arranged to be interfaced with the aligning structure 12 for feeding successive documents 16 thereto in timed relationship with operation of the document aligning structure 12.

Figure 2:
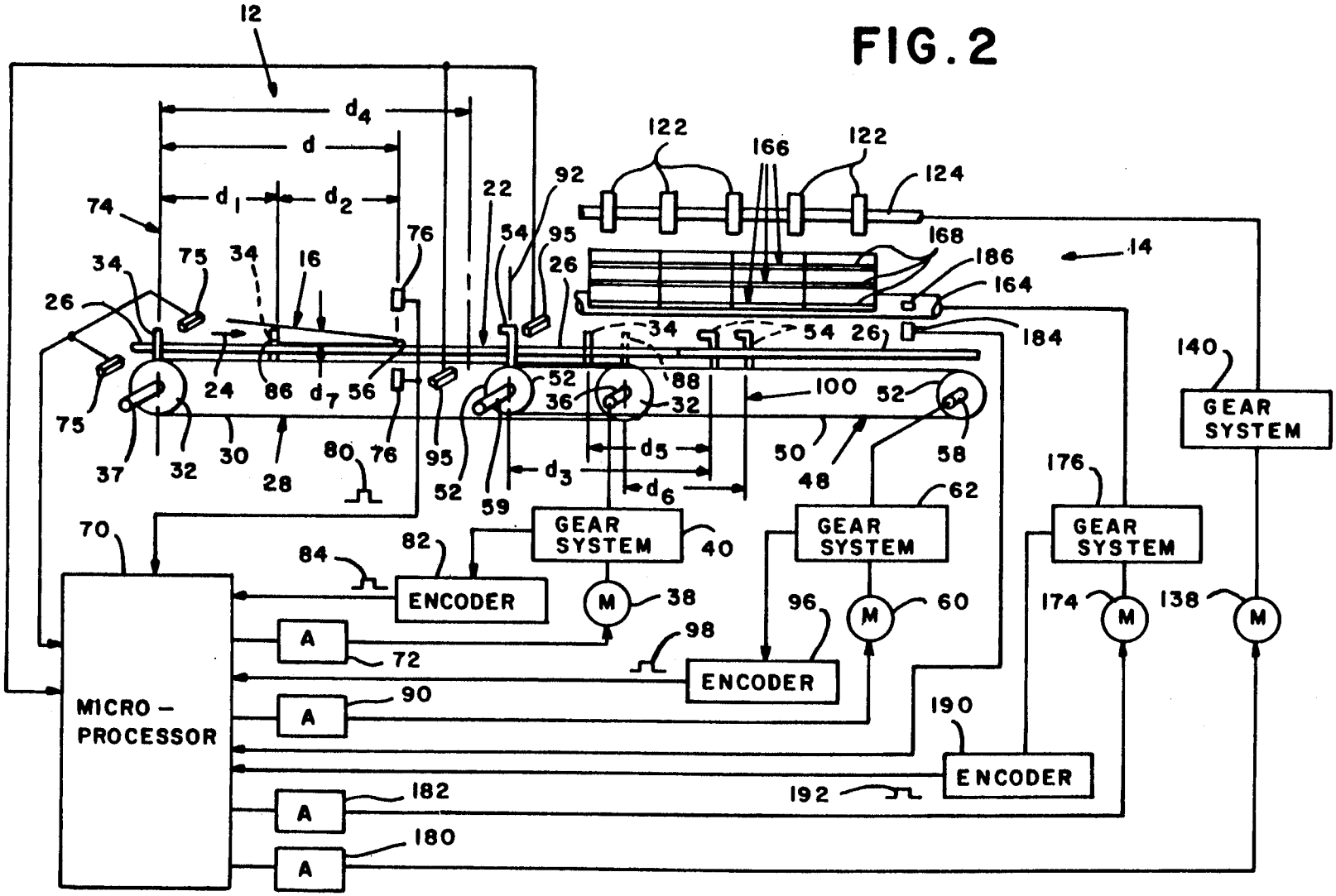
FIG. 2 is a schematic view of structure for controlling the document aligning and feeding structures.

The document aligning structure 12 (FIG. 1) generally includes framework 21 for supporting the various components thereof, and preferably includes an elongate, generally rectangularly-shaped, horizontally oriented, feed deck 22, to which successive documents 16 are fed from the feeding structure 20 for feeding thereon in a downstream path of travel 24. The deck 22 has at least one, and preferably a plurality of, such as three, elongate, parallel-spaced, aperture(s) 26, such as one or more slots, which are formed in the deck 22 so as to longitudinally extend in a direction parallel to the path of travel 24. In addition, the document aligning structure 12 includes document feeding structure 28, comprising at least one, and preferably a plurality of, such as three, parallel-spaced, endless timing belt(s) 30, and a like number of upstream-downstream pairs of timing pulley gear(s) 32 (FIG. 2). Each of the belts 30 is looped about and disposed in meshing engagement with a pair of the pulley gears 32. Preferably, each of the belts 30 (FIG. 1) includes a document feeding member 34, extending outwardly therefrom to permit upward protrusion thereof through a deck aperture 26, for movement therein in the path of travel 24. Moreover, assuming the provision of a plurality of belts 30, the document feeding members 34 are aligned with each other so as to form a row thereof extending perpendicularly transverse to the path of travel 24, for engaging and urging documents 16, fed to the deck 22, downstream in the path of travel 24. For moving each belt 30, the feeding structure 28 also includes a drive shaft 36 to which the downstream pulley gear 32 of each pair of pulley gears 32 is conventionally fixedly connected. And, the feeding structure 28 includes an idler shaft 37, upstream of the drive shaft 36 and spaced parallel thereto, for supporting the upstream pulley gear 32 of each pair of pulley gears 32. Further, the feeding structure 28 preferably includes a conventional d.c. motor 38 (FIG. 2), for driving the shaft 36, and thus the attached downstream pulley gear(s) 32. And, the feeding structure 28 includes a suitable gear system 40 for interfacing the motor 38 with the drive shaft 36.

The document aligning structure 12 (FIG. 1) additionally preferably includes document edge registration structure 48, comprising at least one, and preferably a plurality of, such as three, parallel-spaced, endless timing belt(s) 50, and a like number of upstream-downstream pairs of timing pulley gear(s) 52. Each of the belts 50 is looped about and disposed in meshing engagement with a pair of the pulley gears 52. Preferably, each of the belts 50 includes a document registering member 54, extending outwardly therefrom for upward protrusion thereof through a deck aperture 26, to permit movement therein in the path of travel 24. Moreover, assuming the provision of a plurality of belts 50, the document registering members 54 are aligned with each other so as to form a row thereof extending perpendicularly transverse to the path of travel 24 for receiving thereagainst and registering the downstream edges 56 of respective documents 16 fed thereto by the document feeding structure 28. For moving each belt 50, the edge registration structure 48 also includes a drive shaft 58 to which the downstream pulley gear 52 of each pair of pulley gears 52 is conventionally fixedly connected. And, the registration structure 48 includes an idler shaft 59, upstream of the drive shaft 58 and spaced parallel thereto, for supporting the upstream pulley gears 52 of each pair of pulley gears 52. Further, the registration structure 48 preferably includes a conventional d.c. motor 60 (FIG. 2), for driving the shaft 58, and thus the attached downstream pulley gear(s) 52. And, the registration structure 48 includes a suitable gear system 62 for interfacing the motor 60 with the drive shaft 58.

For controlling the motor 38 (FIG. 2), and thus rotation of the shaft 36 and movement of the belt(s) 30, the document aligning structure 12 generally includes a conventional computer structure, such as a microprocessor 70, which is suitably connected to the motor 38 via a conventional power amplifier 72 and is programmed for causing the belt(s) 30 to move the document feeding members 34 downstream in the path of travel 24 from a home position 74, whereat the members 34 are located vertically above the axis of the idler shaft 37. In this connection, the aligning structure 12 preferably includes conventional sensing structure 75, which is suitably located for sensing one of the feeding members 34 at the home position 74 and is conventionally connected to the microprocessor 70 for providing a signal thereto indicating that the respective members 34 are located at the home position 74. In addition, the aligning structure 12 includes conventional sensing structure 76 for sensing the downstream or leading edge 56 of a document 16 being fed in the path of travel 24. Preferably the sensing structure 76 is located alongside the path of travel 24 at a predetermined distance "d" downstream from the member's home position 74, and is conventionally connected to the microprocessor 70 for providing a suitable signal thereto, such as the signal 80, indicating that the leading edge 56 of a document has been sensed. Further, the aligning structure 12 includes conventional sensing structure 82, such as a suitable shaft encoder, for sensing angular displacement of the drive shaft 36 and thus linear displacement of the belt 30 and document 16. The sensing structure 82 is conventionally connected to the microprocessor 70, and the microprocessor 70 is conventionally programmed for sampling the sensing structure 82 at the end of successive predetermined time intervals, for providing successive count signals thereto, such as the signal 84, which are indicative of respective downstream increments of distance the feeding member(s) 34 have moved during the respective sampling time intervals. And the microprocessor 70 is conventionally programmed for calculating each of such successive increments of the total linear distance "$d_1$" the feeding member(s) 34 and thus the documents 16 have moved from the home position 74. Still further, the microprocessor 70 is conventionally programmed for continuously calculating the aforesaid total distance "$d_1$", and the difference "$d_2$" between the distances "d" and "$d_1$" at the time instant the sensing structure 76 senses the leading edge 56 of a document 16 in the path of travel 24, for determining the distance between the leading edge 56 and trailing edge 86 of the document 16, and thus, the length of a document 16 in the path of travel, which, as shown in FIGS. 1 and 2, is the width of a stuffed envelope 16 between the envelope's opened fold line 86 and downstream edge 56. Moreover, the microprocessor 70 preferably has stored therein data corresponding to a desired trapezoidal-shaped, velocity-versus-time, profile of movement of the document feeding members 34, and thus the document 16, from the home position 74 to a downstream rest position 88, whereat the members 34 are located vertically above the drive shaft 36. And the microprocessor 70 is conventionally programmed for determining, and compensating for, the difference between the actual and desired displacements of the member(s) 34 during each successive sampling time interval, and generating a motor control signal based thereon for causing the motor 38 to drive the feeding members 34 to match the actual incremental velocity thereof with the desired incremental velocity thereof during each succeeding sampling time interval. A more detailed discussion of a conventional closed-loop, sampled data, feedback control system of the type hereinbefore discussed, wherein the actual linear speed of the periphery of a rotary device, such as the pulley gear 52, may be matched with a desired linear speed of a stored trapezoidal-shaped, velocity-versus time profile, may be found in the aforesaid U.S. Pat. No. 4,631,681 for a Microprocessor Controlled D.C. Motor And Application Therefor, issued Dec. 23, 1986 to Salazar et al.

In addition, for controlling the motor 60 (FIG. 2), and thus rotation of the shaft 58 and movement of the belt(s) 50, the aligning structure 12 generally includes conventional computer structure, such as the microprocessor 70, which is suitably connected to the motor 60 via a conventional power amplifier 90 and is programmed for causing the belt(s) 50 to move the document registering members 54 downstream in the path of travel 24 from a home position 92, whereat the members 54 are located vertically above the axis of the idler shaft 59. In this connection, the aligning structure 12 preferably includes conventional sensing structure 95 which is suitably located for sensing one of the registration members 54 at the home position 92 and is conventionally connected to the microprocessor 70 for providing a signal thereto indicating that the respective members 54 are located at the home position 92. Further, the aligning structure 12 includes conventional sensing structure 96, such as a suitable shaft encoder, for sensing angular displacement of the drive shaft 58 and thus linear displacement of the document registration members 54. The sensing structure 96 is conventionally connected to the microprocessor 70 for providing successive count signals thereto, such as the signal 98, at the end of each successive sampling time interval, which are indicative of respective downstream increments of distance the registration members 54 have from the home position 92 moved during the respective sampling time intervals. And the microprocessor 70 is conventionally programmed for calculating the such successive increments and the total downstream linear displacement "$d_3$" of the member(s) 54 in the path of travel 24 from the home position 92, for determining the actual successive downstream linear displacements of the registration members 54 during successive time intervals and the total linear displacement thereof. Still further, the microprocessor 70 is conventionally programmed for causing the motor 60 to commence accelerating the document registration member(s) 54 from rest at the home position 92, when the document's leading edge 56 is approaching the home position 92, say, when the document's leading edge 56 is located at a distance $d_4$ from the feeding members home position 74, and thus in advance of the document's downstream edge 56 engaging the member(s) 54, to cause the document edge registration members 54 to match the actual linear speed of the feeding members 34, at a selected distance, say $d_3$, from the home position 92, before the feeding members 34 have moved downstream to the rest position 88, when the distance $d_5$ between the feeding and registration members, 34 and 54, is equal to the distance $d_2$, i.e., the calculated width dimension of the document 16. Moreover, the microprocessor 70 is conventionally programmed for thereafter causing the motor 60 to drive the registration members 54 to move in synchronism with the movement of the document feeding members 34, whereby both members 34 and 54 are caused to track the desired constant and deceleration velocity portions of the stored velocity versus-time profile of the feeding members 34 in the path of travel 24, as hereinbefore discussed, and come to rest at a position whereat the document's downstream edge 56 is located along a line 100 which is spaced downstream from the rest position 88 of the members 34 by a distance "$d_6$" which is equal to the calculated width dimension "$d_2$" of the document 16.

As thus constructed and arranged, movement of the respective document feeding and registering members, 34 and 54, are each under the control of closed-loop, sampled-data, feedback control systems. Moreover the microprocessor 70 is programmed for synchronizing the desired movement of the registration members 54 with the actual movement of a given document 16 for aligning the downstream edge 56 of the given document 16 along a predetermined edge registration line 100 which extends perpendicularly transverse to the path of travel 24, and is a function of the distance between the leading and trailing edges, 56 and 86, of the given document 16.

The document feeding structure 14 (FIG. 1) generally includes framework, such as the framework 21, for supporting the various components thereof, and preferably includes the feed deck 22 on which the documents 16 are fed and registered as hereinbefore discussed. Moreover, the feed deck 22 preferably includes a deck portion 110 which extends perpendicularly transverse to the path of travel 24, for feeding the documents 16 in a transverse path of travel 112 defined by the document edge registration members 54, and thus along the document edge registration line 100 (FIG. 2) located downstream in the path of travel 24 from the rest position 88 of the document feeding members 34. Moreover, the deck 12 (FIG. 1), includes a row of first aperture 114 and an elongate second aperture 116, which are formed therein so as to extend parallel to the path of travel 24, and thus transverse to the transverse path of travel 112.

In addition the document feeding structure 14 (FIG. 1) generally includes first feeding structure 118 for feeding respective documents 16 in the transverse path of travel 112, and second feeding structure 120 for feeding the respective documents 16 in the transverse path of travel 112 from the document edge registration structure 48 to the first feeding structure 118.

The first feeding structure 118 (FIG. 1) preferably includes a first plurality of lower feed rollers 122, and an elongate feed roller shaft 124 on which the lower rollers 122 are fixedly mounted for rotation with the shaft 124. Preferably, the shaft 124 is conventionally journaled for rotation to the framework 21, so as to longitudinally-extend transverse to the transverse path of travel 112, beneath the deck's row of first apertures 114. And the rollers 122 are mounted at equal intervals along the shaft 124 and dimensioned for protrusion through the first apertures 114, on a one for one basis, for engaging and feeding documents 16 fed thereto on the deck portion 110. In addition, the first feeding structure includes a plurality of upper rollers 126, each of which are associated, on a one for one basis, with one of the lower roller 122, and forms therewith an upper-lower roller pair 128. For individually resiliently urging each of the upper rollers 126 toward its associated lower roller 122, the first feeding structure 118 includes an elongate shaft 130, which is fixedly attached to a pair of opposed upright wall portions 132 of the framework 21 so as to extend parallel to the shaft 124, upstream therefrom and in overhanging relationship with the deck 22. In addition the first feeding structure 118 includes a plurality of elongate pivot arms 134, associated with the upper rollers 126 on a one-for-one basis. Each of the arms 134 has one end suitably pivotally connected to the shaft 130, and has an upper roller 126 conventionally rotatably connected to the other end. And the first feeding structure 118 includes a plurality of coil springs 136, associated with the pivot arms 134 on a one-for-one basis. Each of the springs 136 is coiled around the shaft 130 and has one end suitably connected to the shaft 130 and the other end is suitably connected to its associated pivot arm 134, so as to resiliently urge the arm downwardly, for independently resiliently urging the respective upper rollers 126 downwardly and toward the associated lower roller 122 thereof, to accommodate variations in document thickness "$d_7$". As thus constructed and arranged documents 16 fed between the upper and lower rollers, 126 and 122, are fed downstream in the transverse path of travel 112 by the lower rollers 122 against the respective forces exerted by the individual springs 136. Further, the first feeding structure 118 preferably includes a conventional d.c. motor 138 (FIG. 2), for driving the shaft 130, and includes a suitable gear system 140 for interfacing the motor 138 with the drive shaft 130.

The second feeding structure 120 (FIG. 1) which is preferably aligned with the first feeding structure 118 (FIG. 1) for feeding respective documents 16 between the upper and lower rollers, 126 and 122, against the forces exerted by the springs 136, generally includes a lower idler roller 160, and an elongate idler roller shaft 162 on which the idler roller 160 is mounted for rotation. Preferably, the shaft 162 is conventionally journaled for rotation to the framework 21, so as to longitudinally-extend transverse to the transverse path of travel 112, beneath the deck's second aperture 116. And the roller 160 is dimensioned for protrusion through the second aperture 116 for engagement by a document 16 fed in the transverse path of travel 112. In addition, the second feeding structure includes an elongate drive shaft 164, which is conventionally journaled for rotation to the opposed upright wall portions 132 of the framework 21 so as to extend parallel to the shaft 162 and in overhanging relationship with respect to the deck 22. In addition, the second feeding structure 120 includes at least one, and preferably a plurality of rows 166 of independently flexibly members 168, which are conventionally connected to the shaft 144 so as to extend radially therefrom. Preferably, each of the flexible members 168 is dimensioned for rotation by the shaft 164, into and out of engagement with a document 16 disposed in overlaying relationship with the idler roller 160, whereby the rotating members 168 urge documents 16 into engagement with the roller 160 and cause rotation thereof. Moreover, assuming the feeding structure 14 is interfaced with the aligning structures 12, the members 168 are dimensioned for engaging a document 16 having its downstream edge 56 registered, as hereinbefore discussed, along a line 100 extending in the direction of the path of travel 112. Accordingly, the shaft 164 and flexible members 168 preferably overhang the document aligning structure 12, to permit rotation of the flexible members 168 into and out of engagement with documents 16 located between the document feeding and registration members, 34 and 54. Moreover, each of the rows 166 extends longitudinally of the length of the shaft 164, and parallel to the axis thereof. And the rows 166 form an array of flexible members 168 which extends radially of the shaft 144 and is located within an elongate space, generally designated by the numeral 170, which is substantially semicircularly-shaped, or D-shaped, in transverse cross-section. Still further, the shaft 164, and thus the flexible members 168, have a home position 172, which, as shown in FIG. 1, is the position thereof wherein the two lower-most, oppositely-extending, rows 166 of members 168 are located in a plane extending substantially parallel to the feed deck 22, and the remainder of the rows 166 are arranged therebetween and extend radially upwardly from the shaft 164. Further, the second feeding structure 120 preferably includes a conventional d.c. motor 174 (FIG. 2) for driving the shaft 164, and includes a suitable gear system 176 for interfacing the motor 174 with the drive shaft 164.

For controlling the motor 138 (FIG. 2), and thus rotation of the drive shaft 124, the document feeding structure 14 generally includes conventional computer structure, such as the microprocessor 70, which is suitably connected to the motor 138 via a conventional power amplifier 180 and is programmed for causing the motor 138 to continuously drive the shaft 124. In addition, for controlling the motor 174, and thus rotation of the drive shaft 164 and flexible members 168, the document feeding structure 14 generally includes conventional computer structure, such as the microprocessor 70, which is suitably connected to the motor 174 via a conventional power amplifier 182 and is programmed for causing the motor 170 to drive the shaft 164 through a single revolution from the home position 172 (FIG. 1), and thus from and back to the home position 172. In this connection the feeding structure 14 preferably includes conventional sensing structure 184 (FIG. 2), which is suitably located for sensing the position of the shaft 164, such as by sensing an element 186 of or connected to the shaft 164, when the shaft 164 is located in its home position 172 (FIG. 1). The sensing structure 184 (FIG. 2) is suitably connected to the microprocessor 70 for providing a signal thereto indicating that the shaft 164 is located in its home position 172. Moreover, the microprocessor 70 is preferably programmed to commence rotation of the shaft 164 as of a predetermined time instant subsequent to location of a document's leading edge 56 along the edge registration line 100, thereby ensuring that the document 16 has come to rest. Still further, the feeding structure 14 includes conventional sensing structure 190, such as a suitable shaft encoder, for sensing angular displacement of the drive shaft 164 from the home position 172 The sensing structure 190 is conventionally connected to the microprocessor 70, and the microprocessor 70 is conventionally programmed to sampling the sensing structure 184 at the end of successive predetermined time intervals, for providing successive count signals thereto, such as the signal 192, which correspond to successive actual increments of displacement the periphery of the shaft 164 has moved driving the respective sampling time intervals. In addition, the microprocessor 70 is conventionally programmed for calculating each of such successive increments and the total thereof, from the time instant the shaft 164 commences rotation from the home position 172. Still further, the microprocessor 70 preferably has stored therein a conventional, trapezoidal-shaped, velocity-versus-time, profile of rotation of the shaft 164 from and back to the home position 172. And the microprocessor 70 is conventionally programmed for determining and compensating for the difference between the actual and desired displacements of the periphery of the shaft 164, during each successive sampling time interval, and generating a motor control signal based thereon for causing the motor 190 to drive the shaft 164 to match the actual incremental velocity thereof with the desired incremental velocity thereof during each succeeding sampling time interval.

As hereinabove discussed, the document aligning and feeding structures, 12 and 14, are assumed to be interfaced with one another. However, without departing from the spirit and scope of the invention, either of the structures 12 or 14 may be constructed and arranged for interfacing with conventional structure which not discussed herein in detail. For example, the aligning structure 12 may be constructed and arranged for interfacing with conventional structure for feeding documents 16 therefrom, and the feeding structure 14 may be constructed and arranged for interfacing with either or both conventional structure for feeding documents 16 thereto or feeding documents 16 from conventional document edge registration structure.

In accordance with the objects of the invention there has been described improved document aligning apparatus and improved document feeding apparatus.

What is claimed is:

1. Apparatus for aligning a document, the apparatus comprising:

a. means for feeding a document in a downstream path of travel, the document having an upstream edge and a downstream edge relative to the path of travel, the feeding means including at least one first member extending into the path of travel, the feeding means including first means for moving the at least one first member into engagement with a document in the path of travel;

b. means for registering the downstream edge of a document in a direction extending transverse to the path of travel, the registering means including at least one second member extending into the path of travel, the registering means including second means for moving the at least one second member downstream in the path of travel; and c. means for controlling the moving means for causing the first moving means to move a document engaged thereby into engagement with the at least one second member as said at least one second member moves downstream in said path of travel, and the controlling means including means for controlling the moving means to cause a document to be decelerated to a predetermined rest position in the path of travel.

2. The apparatus according to claim 1, wherein the controlling means includes computer means, the computer means having stored therein a predetermined velocity versus time profile, the computer means programmed for causing the first moving means to move the at least one first member in the path of travel in accordance with said velocity versus time profile, and the computer means programmed for causing the second moving means to move the at least one second member in accordance with a portion of said velocity versus time profile.

3. The apparatus according to claim 1, wherein the controlling means includes means for determining the length between the upstream and downstream edges of a document in the path of travel, and the computer means programmed for causing said second moving means to space said at least one second member downstream from the first member a distance which is equal to said length to facilitate registering the downstream edge of said document along a registration line which is located in the path of travel as a function of the length of said document.

4. The apparatus according to claim 1, wherein the controlling means includes means for causing the first moving means to timely move the at least one first member into the path of travel downstream of the downstream edge of a document.

5. Apparatus for aligning a document, the apparatus comprising:

a. means for feeding a document in a downstream path of travel, the document having an upstream edge and a downstream edge relative to the path of travel;

b. means for registering the downstream edge of a document in a direction extending traverse to the path of travel, the registering means including at least one member extending into the path of travel, the registering means including means for moving the at least one member downstream in the path of travel; and c. means for controlling the feeding means to urge a document into engagement with the at least one moving member, the controlling means including means for controlling the feeding and moving means to cause a document to be decelerated to a predetermined rest position in the path of travel, the controlling means including means for sensing the downstream edge of a document, the controlling means including means for determining a distance between upstream and downstream edges of a document, and the controlling means including means for establishing the predetermined rest position in consideration of the distance.

6. The apparatus to claim 5, wherein the controlling means includes means for causing the moving means to timely move the at least one member into the path of travel downstream of the downstream edge of a document.

7. The apparatus according to claim 5, wherein the moving means is a second moving means, the at least one member is a second member, the feeding means including at least one first member extending into the path of travel, the feeding means including first means for moving the at least one first member into engagement with a document in the path of travel, and the controlling means including means for causing the first moving means to move a document engaged thereby into engagement with the at least one second member as said second member moves downstream in said path of travel.

8. The apparatus according to claim 5, wherein the controlling means includes computer means, the computer means having stored therein a predetermined velocity versus time profile, the computer means programmed for causing the first moving means to move the at least one first member in the path of travel in accordance with said velocity versus time profile, and the computer means programmed for causing the second moving means to move the at least one second member in accordance with a portion of said velocity versus time profile.

9. The apparatus according to claim 5 including computer means programmed for causing said second moving means to space said at least one second member said distance downstream from the first member to facilitate registering the downstream edge of said document along a registration line at said rest position.

10. Apparatus for aligning a document, the apparatus comprising:

a. means for feeding a document in a downstream path of travel, the document having an upstream edge and a downstream edge relative to the path of travel the feeding means including at least one first member extending into the path of travel, the feeding means including first means for moving the at least one first member into engagement with a document in the path of travel;

b. means for registering the downstream edge of a document in a direction extending transverse to the path of travel, the registering means including at least one second member extending into the path of travel, the registering means including second means for moving the at least one second member downstream in the path of travel; and c. means for controlling the feeding means to urge a document into engagement with the at least one second member, the controlling means including means for causing the first moving means to move a document engaged thereby into engagement with the at least one second member as said second member moves downstream in said path of travel, the controlling means including computer means, the computer means having stored therein a predetermined velocity versus time profile, the computer means programmed for causing the first moving means to move that at least one first member in the path of travel in accordance with said velocity versus time profile, and the computer means programmed for causing the second moving means to move the at least one second member in accordance with a portion of said velocity versus time profile.

11. The apparatus according to claim 10, wherein the controlling means includes means for causing the second moving means to timely move the at least one second member into the path of travel downstream of the downstream edge of a document.

12. The apparatus according to claim 10, wherein the controlling means includes means for sensing the downstream edge of a document, the computer means including means for determining a distance between upstream and downstream edges of a document, and the computer means including means for establishing a predetermined document rest position in the path of travel in consideration of the distance.

13. The apparatus according to claim 10, wherein the controlling means includes means for determining the length between the upstream and downstream edges of a document in the path of travel, and the computer means programmed for causing said second moving means to space said at least one second member downstream from the first member a distance which is equal to said length to facilitate registering the downstream edge of said document along a registration line which is located in the path of travel as a function of the length of said document.

14. Apparatus for aligning a document, the apparatus comprising:

a. means for feeding a document in a downstream path of travel, the document having a downstream edge relative to the path of travel the feeding means including a least one first member extending into the path of travel, the feeding means including first means for moving the at least one first member into engagement with a document in the path of travel;

b. means for registering the downstream edge of a document in a direction extending transverse to the path of travel, the registering means including at least one second member extending into the path of travel, the registering means including second means for moving the at least one second member downstream in the path of travel; and c. means for controlling the feeding means to urge a document into engagement with the at least one second member, the controlling means including means for causing the first moving means to move a document engaged thereby into engagement with the at least one second member as said second member moves downstream in said path of travel, controlling means including means for determining the length between the upstream and downstream edges of a document in the path of travel, and computer means programmed for causing said second moving means to space said at least one second member downstream from the first member a distance which is equal to said length to facilitate registering the downstream edge of said document along a registration line which is located in the path of travel as a function of the length of said document.

15. The apparatus according to claim 14, wherein the controlling means includes means for causing the second moving means to timely move the at least one second member into the path of travel downstream of the downstream edge of a document.

16. The apparatus according to claim 14, wherein a document has an upstream edge relative to the path of travel, the controlling means including means for sensing the downstream edge of a document, the controlling means including means for determining a distance between upstream and downstream edges of a document, and the controlling means including means for establishing a predetermined document rest position in the path of travel wherein the document downstream edge is registered along the registration line.

* * * * *